US010453421B2

(12) United States Patent
Um

(10) Patent No.: US 10,453,421 B2
(45) Date of Patent: Oct. 22, 2019

(54) PIXEL CIRCUITS AND METHODS FOR DRIVING THE SAME AND DISPLAY APPARATUSES AND METHODS FOR DRIVING THE SAME

(71) Applicant: BOE TECHNOLOGY GROUP CO., LTD., Beijing (CN)

(72) Inventor: Yoon Sung Um, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 4 days.

(21) Appl. No.: 15/705,604

(22) Filed: Sep. 15, 2017

(65) Prior Publication Data

US 2018/0204536 A1 Jul. 19, 2018

(30) Foreign Application Priority Data

Jan. 17, 2017 (CN) ..... 2017 1 0036348

(51) Int. Cl.
*G09G 5/00* (2006.01)
*G09G 3/36* (2006.01)

(52) U.S. Cl.
CPC ..... *G09G 5/003* (2013.01); *G09G 3/3651* (2013.01); *G09G 3/3659* (2013.01);
(Continued)

(58) Field of Classification Search
None
See application file for complete search history.

(56) References Cited

U.S. PATENT DOCUMENTS

2008/0007573 A1 1/2008 Takeuchi et al.
2011/0205481 A1 8/2011 Aruga et al.
(Continued)

FOREIGN PATENT DOCUMENTS

CN 101211040 A 7/2008
CN 101452168 A 6/2009
CN 102169668 A 8/2011

OTHER PUBLICATIONS

Chinese Office Action dated Sep. 26, 2018, received for corresponding Chinese Application No. 201710036348.X.

*Primary Examiner* — Kenneth B Lee, Jr.
(74) *Attorney, Agent, or Firm* — Kinney & Lange, P.A.

(57) ABSTRACT

Embodiments of the present disclosure provide a pixel circuit and a method for driving the same and a display apparatus and a method for driving the same. The pixel circuit comprises an energy storage circuit, a driving circuit, a display circuit and a reset circuit, wherein the energy storage circuit is connected to a first scanning signal line, a data signal line and the driving circuit, and is configured to store a data signal input through the data signal line under control of the first scanning signal line, the driving circuit is connected to a second scanning signal line and the display circuit and is configured to drive the display circuit to display a picture under control of the second scanning signal line; the display circuit is connected to a second voltage terminal and is configured to display a picture under control of the driving circuit and the second voltage terminal; and the reset circuit is connected to a third scanning signal line, the data signal line and the display circuit, and is configured to set a reset signal input through the data signal line to the display circuit under control of the third scanning signal line to reset a voltage in the display circuit.

12 Claims, 4 Drawing Sheets

(52) U.S. Cl.
CPC ..... *G09G 2300/0809* (2013.01); *G09G 2300/0842* (2013.01); *G09G 2310/02* (2013.01); *G09G 2310/0251* (2013.01); *G09G 2310/061* (2013.01); *G09G 2310/063* (2013.01); *G09G 2320/0247* (2013.01)

(56) References Cited

U.S. PATENT DOCUMENTS

| | | | | |
|---|---|---|---|---|
| 2016/0240134 | A1* | 8/2016 | Yang | G09G 3/3233 |
| 2017/0039944 | A1* | 2/2017 | Ma | G09G 3/325 |
| 2017/0039945 | A1* | 2/2017 | Wang | G09G 3/3258 |
| 2017/0269783 | A1* | 9/2017 | Yang | G06F 3/0412 |

* cited by examiner

PIXEL CIRCUITS AND METHODS FOR DRIVING THE SAME AND DISPLAY APPARATUSES AND METHODS FOR DRIVING THE SAME

CROSS-REFERENCE TO RELATED APPLICATION(S)

The present application claims priority to the Chinese Patent Application No. 201710036348.X, filed on Jan. 17, 2017, entitled "PIXEL CIRCUITS AND METHODS FOR DRIVING THE SAME AND DISPLAY APPARATUSES AND METHODS FOR DRIVING THE SAME," which is incorporated herein by reference in its entirety.

TECHNICAL FIELD

The present disclosure relates to the field of display technology, and more particularly, to a pixel circuit and a method for driving the same and a display apparatus and a method for driving the same.

BACKGROUND

With the development of display technology, requirements for display effects of display apparatuses are gradually increased. When a moving image is displayed on a display apparatus, a flicker phenomenon that occurs when a first frame of image and a second frame of image partly overlap with each other has a great influence on the display effects, which thus has always been a hot research spot for those skilled in the art.

SUMMARY

In order to at least partially solve or alleviate the above-mentioned problems, embodiments of the present disclosure provide a pixel circuit and a method for driving the same and a display apparatus and a method for driving the same.

In order to achieve the above purposes, the following technical solutions are used in the embodiments of the present disclosure.

In a first aspect, there is provided a pixel circuit, comprising an energy storage circuit, a driving circuit, a display circuit and a reset circuit, wherein the energy storage circuit is connected to a first scanning signal line, a data signal line and the driving circuit respectively, and is configured to store a data signal input through the data signal line under the control of the first scanning signal line; the driving circuit is further connected to a second scanning signal line and the display circuit, and is configured to drive the display circuit to display a picture under the control of the second scanning signal line; the display circuit is further connected to a second voltage terminal, and is configured to display a picture under the control of the driving circuit and the second voltage terminal; and the reset circuit is connected to a third scanning signal line, the data signal line and the display circuit respectively, and is configured to set a reset signal input through the data signal line to the display circuit under the control of the third scanning signal line to reset a voltage in the display circuit.

In some embodiments, the energy storage circuit comprises a first transistor and a first capacitor, wherein the first transistor has a gate connected to the first scanning signal line, a first electrode connected to the data signal line and a second electrode connected to the driving circuit; and the first capacitor has a first terminal connected to the second electrode of the first transistor and the driving circuit respectively, and a second terminal connected to a first voltage terminal.

In some embodiments, the driving circuit comprises a second transistor having a gate connected to the second scanning signal line, a first electrode connected to the energy storage circuit and a second electrode connected to the display circuit.

In some embodiments, the display circuit comprises a liquid crystal capacitor and a second capacitor, wherein the liquid crystal capacitor has a first terminal connected to the driving circuit and a second terminal connected to the second voltage terminal, wherein the first terminal is a pixel electrode and the second terminal is a common electrode; and the second capacitor has a first terminal connected to the driving circuit and a second terminal connected to a first voltage terminal.

In some embodiments, the reset circuit comprises a third transistor having a gate connected to the third scanning signal line, a first electrode connected to the data signal line and a second electrode connected to the display circuit.

In some embodiments, when the display circuit comprises a liquid crystal capacitor and a second capacitor, the third transistor has a second electrode connected to a first terminal of the liquid crystal capacitor and a first terminal of the second capacitor respectively.

In some embodiments, both the first voltage terminal and the second voltage terminal are connected to a common voltage terminal.

In a second aspect, there is provided a display apparatus comprising the pixel circuit according to the first aspect.

In a third aspect, there is provided a method for driving the pixel circuit according to the first aspect, wherein a frame of image comprises a charging phase, a reset phase and a display phase, and in the frame of image, the method comprises: in the charging phase, inputting a turn-on signal through the first scanning signal line to control the energy storage circuit to be turned on, and storing, by the energy storage circuit which is turned on, a data signal input through the data signal line; in the reset phase, inputting a turn-on signal through the third scanning signal line to control the reset circuit to be turned on, and outputting, by the reset circuit which is turned on, a reset signal input through the data signal line to the display circuit, to reset a voltage of the display circuit; in the display phase, inputting a turn-off signal through the first scanning signal line to control the energy storage circuit to be turned off; inputting a turn-off signal through the third scanning signal line to control the reset circuit to be turned off; inputting a turn-on signal through the second scanning signal line to control the driving circuit to be turned on, releasing, by the energy storage circuit, the data signal stored therein to the display circuit through the driving circuit which is turned on, to charge the display circuit and drive the display circuit to display a picture; and inputting a turn-off signal through the second scanning signal line to control the driving circuit to be turned off and control the display circuit to hold picture display.

In some embodiments, the method further comprises: in the charging phase, inputting the turn-on signal through the first scanning signal line to control the first transistor to be turned on and storing the data signal input through the data signal line to the first capacitor; in the reset phase, inputting the turn-on signal through the third scanning signal line to control the third transistor to be turned on and outputting the reset signal input through the data signal line to the liquid crystal capacitor and the second capacitor through the third transistor to reset voltages across the liquid crystal capacitor and the second capacitor; in the display phase, inputting the turn-off signal through the first scanning signal line to control the first transistor to be turned off; inputting the turn-off signal through the third scanning signal line to control the third transistor to be turned off; inputting the turn-on signal through the second scanning signal line to control the second transistor to be turned on, releasing, by the first capacitor, the data signal stored therein to the liquid crystal capacitor and the second capacitor through the second transistor to charge the liquid crystal capacitor and the second capacitor, and displaying, by the liquid crystal capacitor, a picture under the driving of the data signal and a signal at the second voltage terminal; and inputting the turn-off signal through the second scanning signal line to control the second transistor to be turned off, and outputting, by the second capacitor, the data signal stored therein to the liquid crystal capacitor to control the liquid crystal capacitor to hold picture display.

In some embodiments, when data signals input in two adjacent frames of image have opposite polarities, polarities of reset signals are same as those of the corresponding data signals.

In some embodiments, the reset signal has a voltage value of 0V or is grounded.

According to a fourth aspect, there is provided a method for driving the display apparatus according to the second aspect, wherein a frame of image comprises a charging phase, a reset phase and a display phase, and in the frame of image, the method comprises: in the charging phase, inputting turn-on signals sequentially through a plurality of first scanning signal lines to control energy storage circuits to be turned on progressively, and storing, by each of the energy storage circuits which are turned on, a data signal input through a corresponding data signal line; in the reset phase, inputting turn-on signals simultaneously through a plurality of third scanning signal lines to control reset circuits to be turned on, and outputting, by each of the reset circuits which are turned on, a reset signal input through a corresponding data signal line to a corresponding display circuit, to reset a voltage of the display circuit; in the display phase, inputting turn-off signals simultaneously through the plurality of first scanning signal lines to control all the energy storage circuits to be turned off; inputting turn-off signals simultaneously through the plurality of third scanning signal lines to control all the reset circuits to be turned off; inputting turn-on signals simultaneously through a plurality of second scanning signal lines to control all the driving circuits to be turned on, releasing, by each of the energy storage circuits, the data signal stored therein to a corresponding display circuit through a corresponding driving circuit of the driving circuits which are turned on, to charge the display circuit and drive the display circuit to display a picture; and inputting turn-off signals simultaneously through the plurality of second scanning signal lines to control the driving circuits to be turned off and control the display circuits to hold picture display.

BRIEF DESCRIPTION OF THE DRAWINGS

In order to more clearly illustrate the technical solutions in the embodiments of the present disclosure or in the related art, the accompanying drawings, which are intended to be used in the description of the embodiments or related art, will be briefly described below. It will be apparent that the accompanying drawings in the following description are merely some embodiments of the present disclosure, and other accompanying drawings can further be obtained by those of ordinary skill in the art according to the accompanying drawings without contributing any creative work.

DETAILED DESCRIPTION

The technical solutions in the embodiments of the present disclosure will be described clearly and completely below in conjunction with the accompanying drawings in the embodiments of the present disclosure, and it will be apparent that the described embodiments are merely a part of the embodiments of the present disclosure instead of all the embodiments. All other embodiments obtained by those of ordinary skill in the art based on the embodiments of the present disclosure without contributing any creative work are within the protection scope of the present disclosure.

Figure 1:
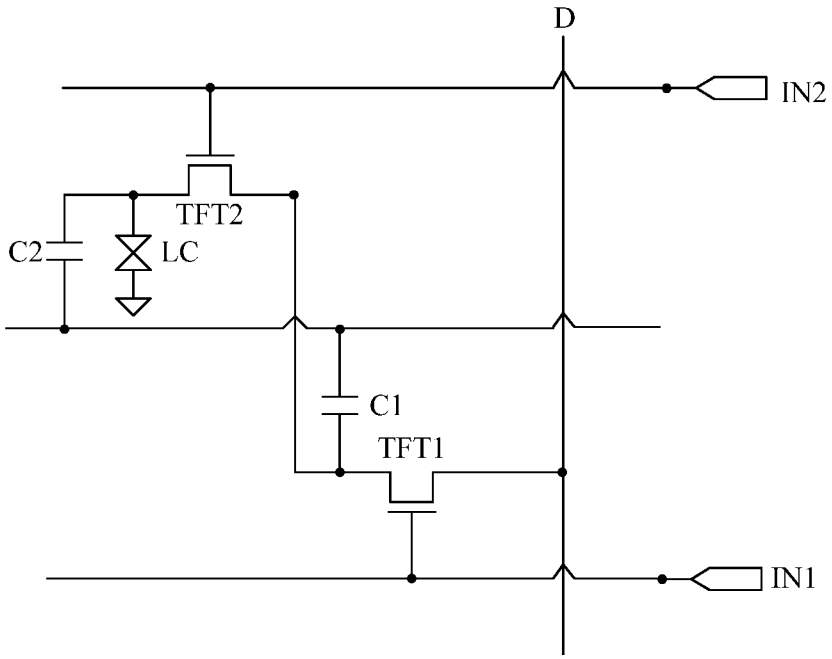
FIG. 1 is a diagram of a pixel circuit according to the related art.

In the related art, there is provided a display apparatus comprising a plurality of pixel units which are arranged in an array. As shown in FIG. 1, each pixel unit comprises a first transistor TFT1, a second transistor TFT2, a first capacitor C1, a second capacitor C2 and a liquid crystal capacitor LC, wherein the liquid crystal capacitor LC has a function of holding charges.

A specific display principle is as follows. A first scanning signal line IN1 controls the first transistor TFT1 to be turned on and the first capacitor C1 stores a data signal input through a data signal line D; the first scanning signal line IN1 controls the first transistor TFT1 to be turned off, a second scanning signal line IN2 controls the second transistor TFT2 to be turned on, and the first capacitor C1 outputs a first data signal to the liquid crystal capacitor LC and the second capacitor C2 to drive the liquid crystal capacitor LC to display a picture; the second scanning signal line IN2 controls the second transistor TFT2 to be turned off; and the second capacitor C2 outputs the data signal stored therein to the liquid crystal capacitor LC to drive the liquid crystal capacitor LC to hold picture display.

During display, as charges during display of a previous frame are stored still in the liquid crystal capacitor LC, residual charges in the liquid crystal capacitor LC are $Qp=Cp\times Vp$, where Cp is capacitance of the liquid crystal capacitor LC, and Vp is a residual voltage across the liquid crystal capacitor LC. Charges supplied from the first capacitor C1 to the liquid crystal capacitor LC are $Q=C\times Vd$, where C is capacitance of the first capacitor C1 and Vd is an input voltage across the liquid crystal capacitor LC during the display. In this way, total charges in the liquid crystal capacitor LC are $Qt=Q+Qp=C\times Vd+Cp\times Vp=Vd'\times(C+Cp)$, where Vd' is a voltage released from the first capacitor C1 to the liquid crystal capacitor LC. Thereby, $Vd'=(C\times Vd+Cp\times Vp)/(C+Cp)$ may be deduced. As a polarity of Vp is opposite to a polarity of Vd, Vp may offset Vd, which thus may result in a considerable voltage loss. In addition, in a case that the polarity of Vp is opposite to the polarity of Vd, it needs to increase C to ensure normal display. However, if C becomes large, the TFT1 for charging C1 is also increased, which may cause a large loss of an aperture rate of sub-pixels.

Figure 2:
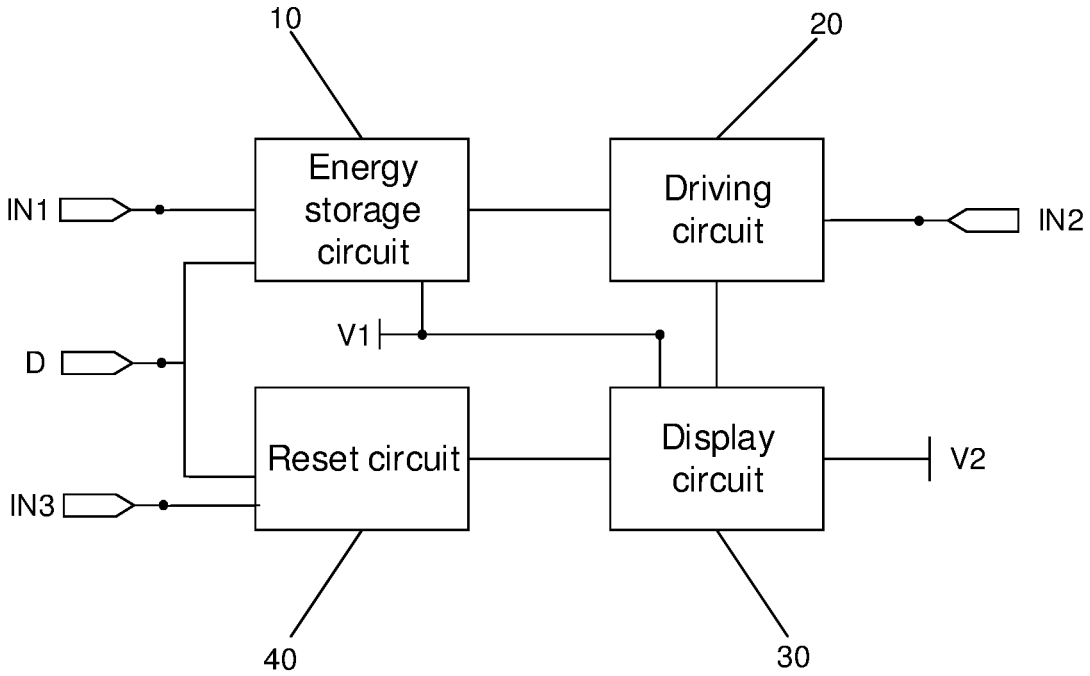
FIG. 2 is a structural diagram of a pixel circuit according to an embodiment of the present disclosure.

In order to at least partially alleviate or solve the problem, the embodiments of the present disclosure provide a pixel circuit, as shown in FIG. 2, comprising an energy storage circuit 10, a driving circuit 20, a display circuit 30, and a reset circuit 40.

The energy storage circuit 10 is connected to a first scanning signal line IN1, a data signal line D, a first voltage terminal V1 and the driving circuit 20 respectively, and is configured to store a data signal input through the data signal line D under the control of the first scanning signal line IN1.

The driving circuit 20 is further connected to a second scanning signal line IN2 and the display circuit 30 and is configured to drive the display circuit 30 to display a picture under the control of the second scanning signal line IN2.

The display circuit 30 is further connected to the first voltage terminal V1 and a second voltage terminal V2 and is configured to display a picture under the control of the driving circuit 20 and the second voltage terminal V2.

The reset circuit 40 is connected to a third scanning signal line IN3, the data signal line D and the display circuit 30 respectively, and is configured to set a reset signal input through the data signal line D to the display circuit 30 under the control of the third scanning signal line IN3 to reset a voltage in the display circuit 30.

The reset signal is not specifically limited, as long as a residual voltage in the display circuit 30 can be reduced.

In this way, the reset circuit 40 is added in the pixel circuit, and before the driving circuit 20 and the second voltage terminal V2 control the display circuit 30 for display, the reset circuit 40 outputs the reset signal input through the data signal line D to the display circuit 30 under the control of the third scanning signal line IN3 to reset the voltage in the display circuit 30 so that a polarity of the voltage in the display circuit 30 is same as a polarity of the data signal input through the data signal line D or reset the voltage in the display circuit 30 to 0V, which prevents the voltage in the display circuit 30 from offsetting the data signal input through the data signal line D, thereby reducing the voltage loss. The embodiments of the present disclosure can increase the aperture ratio of the pixels when normal display can be ensured without increasing the energy storage capacity of the energy storage circuit 10.

A specific structure of each circuit in FIG. 2 will be described in detail below.

Figure 3:
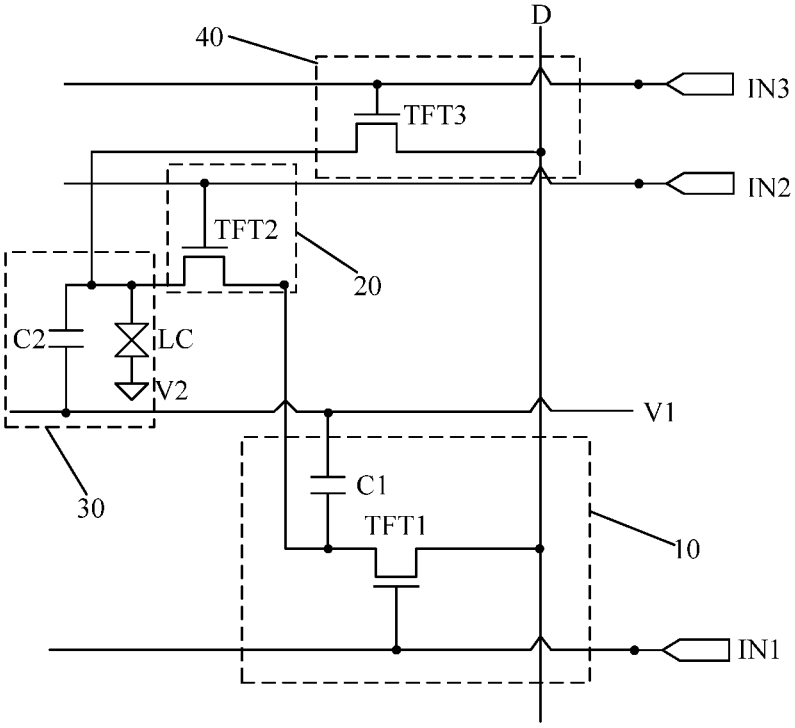
FIG. 3 is a specific circuit diagram of various circuits in FIG. 2.

Specifically, as shown in FIG. 3, the energy storage circuit 10 comprises a first transistor TFT1 and a first capacitor C1, wherein the first transistor TFT1 has a gate connected to the first scanning signal line IN1, a first electrode connected to the data signal line D and a second electrode connected to the driving circuit 20.

The first capacitor C1 has a first terminal connected to the second electrode of the first transistor TFT1 and the driving circuit 20 respectively, and a second terminal connected to the first voltage terminal V1.

The driving circuit 20 comprises a second transistor TFT2 having a gate connected to the second scanning signal line IN2, a first electrode connected to the energy storage circuit 10 and a second electrode connected to the display circuit 30.

The display circuit 30 comprises a liquid crystal capacitor LC and a second capacitor C2. The liquid crystal capacitor LC has a first terminal connected to the driving circuit 20 and a second terminal connected to the second voltage terminal V2, wherein the first terminal is a pixel electrode and the second terminal is a common electrode.

The second capacitor C2 has a first terminal connected to the driving circuit 20 and a second terminal connected to the first voltage terminal V1.

The reset circuit 40 comprises a third transistor TFT3 having a gate connected to the third scanning signal line IN3, a first electrode connected to the data signal line D and a second electrode connected to the display circuit 30.

Further, specifically, the third transistor TFT3 has a second electrode connected to the first terminal of the liquid crystal capacitor LC and the first terminal of the second capacitor C2 respectively.

Figure 4:
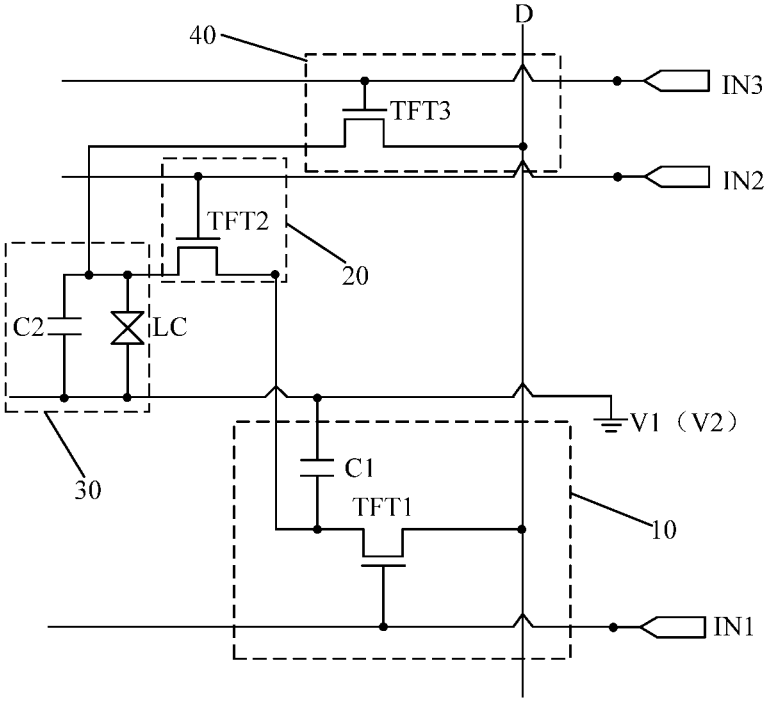
FIG. 4 is another specific circuit diagram of various circuits in FIG. 2.

Further, in another embodiment illustrated in FIG. 4, both the first voltage terminal V1 and the second voltage terminal V2 may be connected to a common voltage terminal. The common voltage terminal may be grounded or may be at a fixed voltage, and FIG. 4 is illustrated by taking the common voltage terminal being grounded as an example.

It is to be noted that the transistors described above may be N-type transistors or P-type transistors, or may also be enhancement mode transistors or depletion mode transistors; the first electrodes of the transistors may be sources, and the second electrodes of the transistors may be drains, or the first electrodes of the transistors may be drains, and the second electrodes of the transistors may be sources, and the present disclosure is not limited thereto.

Turn-on and turn-off conditions of each of the transistors in the pixel circuits shown in FIGS. 3 and 4 in different phases (P1-P3) of a frame of image (for example, $U^{th}$ frame, where U≥1 and U is a positive integer) will be described in detail below in conjunction with FIG. 5 by taking each of the transistors being an N-type transistor as an example. Low levels are constantly output at the first voltage terminal V1 and the second voltage terminal V2.

In the charging phase P1, IN1=1, IN2=0 and IN3=0, where "0" represents a low level, and "1" represents a high level.

At this time, as the first signal line IN1 outputs a high level, the first transistor TFT1 is turned on, and the first capacitor C1 stores the data signal Vd input through the data signal line D, so that the charges on the first capacitor C1 are Q=C×Vd, where C is the capacitance of the first capacitor C1. As both the second signal line IN2 and the third signal line IN3 output a low level, both the second transistor TFT2 and the third transistor TFT3 are turned off.

In the reset phase P1, IN1=0, IN2=0 and IN3=1.

At this time, as the third signal line IN3 outputs a high level, the third transistor TFT3 is turned on, and the reset signal Vr input through the data signal line D is output to the liquid crystal capacitor LC and the second capacitor C2 through the third transistor TFT3, so that the charges on the liquid crystal capacitor LC are Qp=Cp×Vr, where Cp is the capacitance of the liquid crystal capacitor LC. As both the second signal line IN2 and the first signal line IN1 output a low level, both the second transistor TFT2 and the first transistor TFT1 are turned off. It should be noted that when the voltage across the liquid crystal capacitor LC is reset, a reset process is also completed for the voltage across the second capacitor C2.

In the display phase P3, the display phase P3 is divided into two phases.

In a charging display phase P31, IN1=0, IN2=1 and IN3=0.

At this time, as the second signal line IN2 outputs a high level, the second transistor TFT2 is turned on, the first capacitor C1 releases the data signal Vd stored therein to the liquid crystal capacitor LC and the second capacitor C2 through the second transistor TFT2 to charge the liquid crystal capacitor LC and the second capacitor C2, and the liquid crystal capacitor LC displays a picture under the driving of the data signal Vd and a signal at the second voltage terminal V2. In this phase, the total charges in the liquid crystal capacitor LC are Qt=Q+Qp=C×Vd+Cp×Vr=Vd'×(C+Cp), where Vd' is the voltage released from the first capacitor C1 to the liquid crystal capacitor LC. Thereby, Vd'=(C×Vd+Cp×Vr)/(C+Cp) may be deduced. As the reset signal Vr and the data signal Vd input through the data signal line D have the same polarity, there is no phenomenon that Vr and Vd offset each other, so that the voltage loss can be reduced. In this way, there is no need to increase the storage capacity of the first capacitor C1 to ensure the normal display, and therefore the aperture ratio of the sub-pixels can be increased. It should be noted that a value of the reset signal Vr should be selected reasonably according to practical situations of the pixel circuit.

In addition, if the reset signal Vr input through the data signal line D is Vr=0V, the residual charges in the liquid crystal capacitor LC are 0V, charges input to the liquid crystal capacitor LC are the same in various frames, and Qt=Q+Qp=C×Vd+0, which can minimize the voltage loss and enable effects of the picture display to be optimal.

In a hold display phase P32, IN1=1, IN2=0 and IN3=0.

At this time, as the second signal line IN2 inputs a low level, the second transistor TFT2 is turned off, and the first capacitor C1 stops supplying power to the display circuit 30. The second capacitor C2 outputs the data signal stored therein to the liquid crystal capacitor LC so that the liquid crystal capacitor LC holds picture display.

In addition, as the first signal line IN1 outputs a high level, the first transistor TFT1 is turned on, and the first capacitor C1 stores the data signal Vd input through the data signal line D. As an input terminal of the third signal line IN3 outputs a low level, the third transistor TFT3 is turned off.

In this way, a hold display phase P32 of a $U^{th}$ frame is overlapped with a charging phase P1 of a $(U+1)^{th}$ frame, so as to prevent a picture displayed in the $U^{th}$ frame from being partially overlapped with a picture displayed in the $U+1^{th}$ frame, which well eliminates the flicker problem in the screen.

It is to be noted that, firstly, the turn-on and turn-off processes of the transistors in the above embodiments are described by taking all the transistors being N-type transistors as an example. When all the transistors are P-type transistors, it needs to reverse various control signals in FIG. 5, and turn-on and turn-off processes of transistors of various circuits in the pixel circuit are same as described above, and will not be repeated here.

Secondly, when the voltage in the display circuit 30 is not reset by the reset circuit 40, a correspondence relationship between a ratio of the capacitance of the first capacitor C1 relative to the capacitance of the liquid crystal capacitor LC and an actual value of a received voltage across the liquid crystal capacitor LC when the input data signal is Vd=8V is experimentally obtained, as shown in Table 1. After the voltage in the display circuit 30 is reset by the reset circuit 40, a correspondence relationship between a ratio of the capacitance of the first capacitor C1 relative to the capacitance of the liquid crystal capacitor LC and an actual value of a received voltage across the liquid crystal capacitor LC when the input data signal is Vd=8V is experimentally obtained, as shown in Table 2. It can be seen from the comparison between Table 1 and Table 2 that reset of the voltage in the display circuit 30 by the reset circuit 40 before the display can reduce the requirements for the capacity of the first capacitor C1, thereby reducing a size of the first thin film transistor TFT1 connected to the first capacitor C1 to achieve the effect of increasing the aperture ratio of the sub-pixels. After the reset circuit 40 is added in the pixel circuit, a range of C:Cp=1:1-2:1 can well ensure normal display of the sub-pixels.

TABLE 1

| C:Cp | 1:1 | 2:1 | 3:1 | 4:1 | 5:1 | 6:1 |
|---|---|---|---|---|---|---|
| Actual Vp | 4.07 | 4.84 | 5.4 | 5.73 | 6.02 | 6.23 |
| Vp/Vd | 51% | 61% | 68% | 72% | 75% | 78% |

TABLE 2

| C:Cp | 1:1 | 2:1 | 3:1 | 4:1 | 5:1 | 6:1 |
|---|---|---|---|---|---|---|
| Actual Vp | 5.7 | 6.3 | 6.6 | 6.8 | 7.01 | 7.14 |
| Vp/Vd | 71.3% | 78.8% | 82.5% | 85% | 87.6% | 89.3% |

The embodiments of the present disclosure further provide a method for driving the pixel circuit described above, wherein a frame of image comprises a charging phase P1, a reset phase P2 and a display phase P3, and in the frame of image, the method comprises:

in the charging phase P1, inputting a turn-on signal through the first scanning signal line IN1 to control the energy storage circuit 10 to be turned on, and storing, by the energy storage circuit 10 which is turned on, a data signal input through the data signal line D;

in the reset phase P2, inputting a turn-on signal through the third scanning signal line IN3 to control the reset circuit 40 to be turned on, and outputting, by the reset circuit 40 which is turned on, a reset signal input through the data signal line D to the display circuit 30, to reset a voltage of the display circuit 30;

in the display phase P3, in a charging display phase P31, inputting a turn-off signal through the first scanning signal line IN1 to control the energy storage circuit 10 to be turned off;

inputting a turn-off signal through the third scanning signal line IN3 to control the reset circuit 40 to be turned off;

inputting a turn-on signal through the second scanning signal line IN2 to control the driving circuit 20 to be turned on, releasing, by the energy storage circuit 10, the data signal stored therein to the display circuit 30 through the driving circuit 20 which is turned on, to charge the display circuit 30 and drive the display circuit 30 to display a picture; and in a hold display phase P32, inputting a turn-off signal through the second scanning signal line IN2 to control the driving circuit 20 to be turned off and control the display circuit 30 to hold picture display.

In this way, the reset circuit 40 is added in the pixel circuit, and before the driving circuit 20 and the second voltage terminal V2 control the display circuit 30 for display, the reset circuit 40 outputs the reset signal input through the data signal line D to the display circuit 30 under the control of the third scanning signal line IN3 to reset the voltage in the display circuit 30 so that a polarity of the voltage in the display circuit 30 is same as a polarity of the data signal input through the data signal line D or reset the voltage in the display circuit 30 to 0V, which prevents the voltage in the display circuit 30 from offsetting the data signal input through the data signal line D, thereby reducing the voltage loss. The embodiments of the present disclosure can increase the aperture ratio of the pixels when normal display can be ensured without increasing the energy storage capacity of the energy storage circuit 10.

Figure 5:
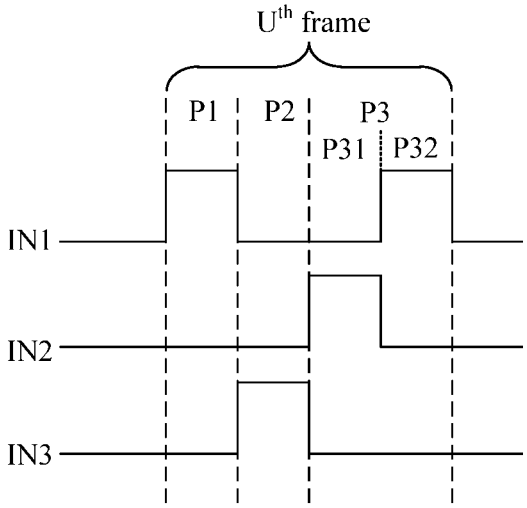
FIG. 5 is a timing diagram of a pixel circuit according to an embodiment of the present disclosure.

Specifically, as shown in FIG. 5, in the charging phase P1, inputting the turn-on signal through the first scanning signal line IN1 to control the first transistor TFT1 to be turned on and storing the data signal input through the data signal line D to the first capacitor C1;

in the reset phase P2, inputting the turn-on signal through the third scanning signal line IN3 to control the third transistor TFT3 to be turned on and outputting the reset signal input through the data signal line D to the liquid crystal capacitor LC and the second capacitor C2 through the third transistor TFT3 to reset voltages across the liquid crystal capacitor LC and the second capacitor C2;

wherein, when data signals input in two adjacent frames of image have opposite polarities, a polarity of a reset signal is same as that of a data signal in a frame of image;

alternatively, when the polarities of the data signals input in the two adjacent frames of image are not taken into account, the reset signal may have a voltage value of 0V or may be grounded;

in the display phase P3, in the charging display phase P31, inputting the turn-off signal through the first scanning signal line IN1 to control the first transistor TFT1 to be turned off;

inputting the turn-off signal through the third scanning signal line IN3 to control the third transistor TFT3 to be turned off;

inputting the turn-on signal through the second scanning signal line IN2 to control the second transistor TFT2 to be turned on, releasing, by the first capacitor C1, the data signal stored therein to the liquid crystal capacitor LC and the second capacitor C2 through the second transistor TFT2 to charge the liquid crystal capacitor LC and the second capacitor C2, and displaying, by the liquid crystal capacitor LC, a picture under the driving of the data signal and a signal at the second voltage terminal V2; and in the hold display phase P32, inputting the turn-off signal through the second scanning signal line IN2 to control the second transistor TFT2 to be turned off, and outputting, by the second capacitor C2, the data signal stored therein to the liquid crystal capacitor LC to control the liquid crystal capacitor LC to hold picture display.

The embodiments of the present disclosure further provide a display apparatus comprising any of the pixel circuits described above, and the display apparatus have the same structure and advantageous effects as those of the pixel circuits according to the embodiments described above. As the structure and the advantageous effects of the pixel circuits have been described in detail in the embodiments described above, the description thereof will not be repeated here.

Figure 6:
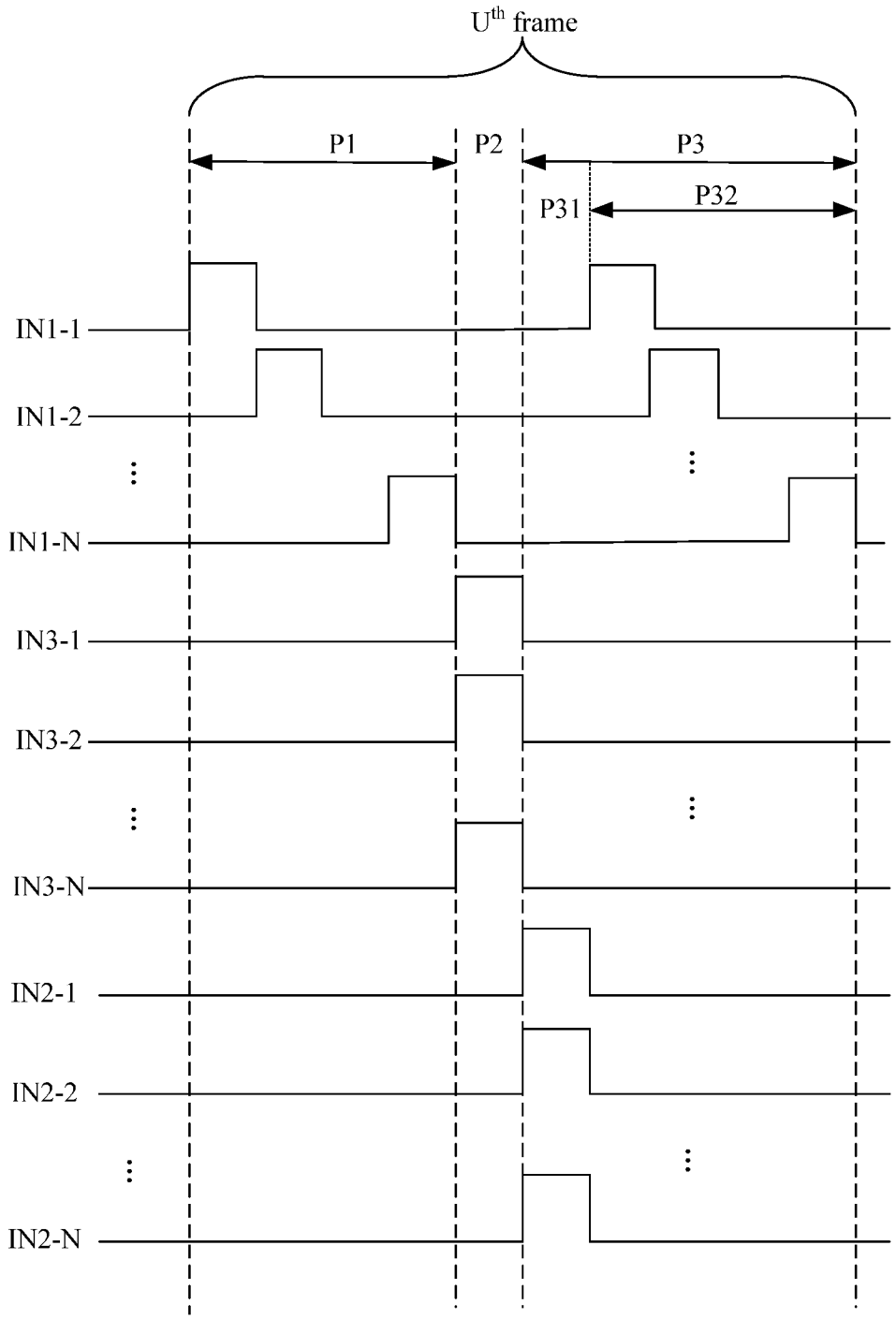
FIG. 6 is a timing diagram of a display apparatus according to an embodiment of the present disclosure.

The embodiments of the present disclosure further provide a method for driving a display apparatus, wherein as shown in FIG. 6, a frame of image comprises a charging phase P1, a reset phase P2 and a display phase P3, and in the frame of image, the method comprises:

in the charging phase P1, inputting turn-on signals sequentially through a plurality of first scanning signal lines IN1 to control energy storage circuits 10 to be turned on progressively, and storing, by each of the energy storage circuits 10 which are turned on, a data signal input through a corresponding data signal line D;

in the reset phase P2, inputting turn-on signals simultaneously through a plurality of third scanning signal lines IN3 to control reset circuits 40 to be turned on, and outputting, by each of the reset circuits 40 which are turned on, a reset signal input through a corresponding data signal line D to a corresponding display circuit 30, to reset a voltage of the display circuit 30;

in the display phase P3, in the charging display phase P31, inputting turn-off signals simultaneously through the plurality of first scanning signal lines IN1 to control all the energy storage circuits 10 to be turned off;

inputting turn-off signals simultaneously through the plurality of third scanning signal lines IN3 to control all the reset circuits 40 to be turned off;

inputting turn-on signals simultaneously through a plurality of second scanning signal lines IN2 to control all the driving circuits 20 to be turned on, releasing, by each of the energy storage circuits 10, the data signal stored therein to a corresponding display circuit 30 through a corresponding driving circuit 20 of the driving circuits 20 which are turned on, to charge the display circuit 30 and drive the display circuit 30 to display a picture; and in the hold display phase P32, inputting turn-off signals simultaneously through the plurality of second scanning signal lines IN2 to control the driving circuits 20 to be turned off and control the display circuits 30 to hold picture display.

When turn-on signals are input simultaneously through the third scanning signal lines IN3, the reset signals inputted through the data signal lines D may be 0V or another preset value, for example, may be 1V. When the input reset signals are 1V, if the data signals input in the two adjacent frames of image have opposite polarities, the reset signal input in the $(U+1)^{th}$ frame is −1V when the reset signal input in the $U^{th}$ frame is 1V.

Further, the second scanning signal lines IN2 may be turned on immediately while the third scanning signal lines IN3 are turned off as shown in FIG. 6, or may be turned on a time difference of more than 0 μs after the third scanning signal lines IN3 are turned off.

The embodiments of the present disclosure provide a pixel circuit and a method for driving the same and a display apparatus and a method for driving the same. The reset circuit is added in the pixel circuit, and before the driving circuit and the second voltage terminal control the display circuit for display, the reset circuit outputs the reset signal input through the data signal line to the display circuit under the control of the third scanning signal line to reset the voltage in the display circuit so that a polarity of the voltage in the display circuit is same as a polarity of the data signal input through the data signal line or reset the voltage in the display circuit to 0V, which prevents the voltage in the display circuit from offsetting the data signal input through the data signal line, thereby reducing the voltage loss. Compared with the related art, the present disclosure can increase the aperture ratio of the pixels when normal display can be ensured without increasing the energy storage capacity of the energy storage circuit.

The foregoing description is only some specific embodiments of the present disclosure, but the protection scope of the present disclosure is not limited thereto. Any variation or substitution which is easily reached by those skilled in the art within the technical scope disclosed in the present disclosure shall fall into the protection scope of the present disclosure. Accordingly, the protection scope of the present disclosure should be based on the protection scope of the claims.

The invention claimed is:

1. A pixel circuit, comprising an energy storage circuit, a driving circuit, a display circuit, and a reset circuit, wherein:

the energy storage circuit is connected to a first scanning signal line, a data signal line, and the driving circuit, respectively, and is configured to store a data signal input through the data signal line under control of the first scanning signal line;

the driving circuit is further connected to a second scanning signal line and the display circuit, and is configured to drive the display circuit to display a picture under control of the second scanning signal line;

the display circuit is further connected to a second voltage terminal, and is configured to display a picture under control of the driving circuit and the second voltage terminal;

the reset circuit is connected to a third scanning signal line, the data signal line, and the display circuit, respectively, and is configured to set a reset signal input through the data signal line to the display circuit under control of the third scanning signal line to reset a voltage in the display circuit;

the display circuit comprises a liquid crystal capacitor and a second capacitor;

the liquid crystal capacitor has a first terminal connected to the driving circuit and a second terminal connected to the second voltage terminal, wherein the first terminal is a pixel electrode and the second terminal is a common electrode; and the second capacitor has a first terminal connected to the driving circuit and a second terminal connected to a first voltage terminal.

2. The pixel circuit according to claim 1, wherein the energy storage circuit comprises a first transistor and a first capacitor, wherein:

the first transistor has a gate connected to the first scanning signal line, a first electrode connected to the data signal line, and a second electrode connected to the driving circuit; and the first capacitor has a first terminal connected to the second electrode of the first transistor and the driving circuit, respectively, and a second terminal connected to a first voltage terminal.

3. The pixel circuit according to claim 1, wherein the driving circuit comprises a second transistor having a gate connected to the second scanning signal line, a first electrode connected to the energy storage circuit, and a second electrode connected to the display circuit.

4. The pixel circuit according to claim 1, wherein the reset circuit comprises a third transistor having a gate connected to the third scanning signal line, a first electrode connected to the data signal line and a second electrode connected to the display circuit.

5. The pixel circuit according to claim 1, wherein the reset circuit comprises a third transistor having a gate connected to the third scanning signal line, a first electrode connected to the data signal line and a second electrode connected to the display circuit, and wherein:

the third transistor has a second electrode connected to a first terminal of the liquid crystal capacitor and a first terminal of the second capacitor, respectively.

6. The pixel circuit according to claim 2, wherein both the first voltage terminal and the second voltage terminal are connected to a common voltage terminal.

7. A display apparatus comprising the pixel circuit according to claim 1.

8. A method for driving the pixel circuit according to claim 1, wherein a frame of image comprises a charging phase, a reset phase, and a display phase, and in the frame of image, the method comprises:

in the charging phase, inputting a turn-on signal through the first scanning signal line to control the energy storage circuit to be turned on, and storing, by the energy storage circuit which is turned on, a data signal input through the data signal line;

in the reset phase, inputting a turn-on signal through the third scanning signal line to control the reset circuit to be turned on, and outputting, by the reset circuit which is turned on, a reset signal input through the data signal line to the display circuit, to reset a voltage of the display circuit;

in the display phase, inputting a turn-off signal through the first scanning signal line to control the energy storage circuit to be turned off;

inputting a turn-off signal through the third scanning signal line to control the reset circuit to be turned off;

inputting a turn-on signal through the second scanning signal line to control the driving circuit to be turned on, releasing, by the energy storage circuit, the data signal stored therein to the display circuit through the driving circuit which is turned on, to charge the display circuit and drive the display circuit to display a picture; and inputting a turn-off signal through the second scanning signal line to control the driving circuit to be turned off and control the display circuit to keep displaying the picture.

9. The method according to claim 8, wherein the method further comprises:

in the charging phase, inputting the turn-on signal through the first scanning signal line to control the first transistor to be turned on and storing the data signal input through the data signal line to the first capacitor;

in the reset phase, inputting the turn-on signal through the third scanning signal line to control the third transistor to be turned on and outputting the reset signal input through the data signal line to the liquid crystal capacitor and the second capacitor through the third transistor to reset voltages across the liquid crystal capacitor and the second capacitor;

in the display phase, inputting the turn-off signal through the first scanning signal line to control the first transistor to be turned off;

inputting the turn-off signal through the third scanning signal line to control the third transistor to be turned off;

inputting the turn-on signal through the second scanning signal line to control the second transistor to be turned on, releasing, by the first capacitor, the data signal stored therein to the liquid crystal capacitor and the second capacitor through the second transistor to charge the liquid crystal capacitor and the second capacitor, and displaying, by the liquid crystal capacitor, a picture under the driving of the data signal and a signal at the second voltage terminal; and inputting the turn-off signal through the second scanning signal line to control the second transistor to be turned off, and outputting, by the second capacitor, the data signal stored therein to the liquid crystal capacitor to control the liquid crystal capacitor to keep displaying the picture.

10. The method according to claim 8, wherein when data signals input in two adjacent image frames have opposite polarities, polarities of the reset signals are the same as those of the corresponding data signals.

11. The method according to claim 8, wherein the reset signal has a voltage value of 0V or is grounded.

12. A method for driving the display apparatus according to claim 7, wherein a frame of image comprises a charging phase, a reset phase, and a display phase, and in the frame of image, the method comprises:

in the charging phase, inputting turn-on signals sequentially through a plurality of first scanning signal lines to control energy storage circuits to be turned on line by line, and storing, by each of the energy storage circuits which are turned on, a data signal input through a corresponding data signal line;

in the reset phase, inputting turn-on signals simultaneously through a plurality of third scanning signal lines to control reset circuits to be turned on, and outputting, by each of the reset circuits which are turned on, a reset signal input through a corresponding data signal line to a corresponding display circuit, to reset a voltage of the display circuit;

in the display phase, inputting turn-off signals simultaneously through the plurality of first scanning signal lines to control all the energy storage circuits to be turned off;

inputting turn-off signals simultaneously through the plurality of third scanning signal lines to control all the reset circuits to be turned off;

inputting turn-on signals simultaneously through a plurality of second scanning signal lines to control all the driving circuits to be turned on, releasing, by each of the energy storage circuits, the data signal stored therein to a corresponding display circuit through a corresponding driving circuit of the driving circuits which are turned on, to charge the display circuit and drive the display circuit to display a picture; and inputting turn-off signals simultaneously through the plurality of second scanning signal lines to control the driving circuits to be turned off and control the display circuits to keep displaying the picture.

* * * * *